US006645042B2

(12) United States Patent
Davis

(10) Patent No.: US 6,645,042 B2
(45) Date of Patent: Nov. 11, 2003

(54) BACKLESS, STRAPLESS BRA WITH SWIVEL SNAP SYSTEM

(75) Inventor: Theodore L. Davis, Chester, MA (US)

(73) Assignee: Brazabra Corporation, Lee, MA (US)

( * ) Notice: Subject to any disclaimer, the term of this patent is extended or adjusted under 35 U.S.C. 154(b) by 140 days.

(21) Appl. No.: 09/981,010

(22) Filed: Oct. 17, 2001

(65) Prior Publication Data

US 2003/0073378 A1 Apr. 17, 2003

(51) Int. Cl.[7] ..... A41C 3/00
(52) U.S. Cl. ..... 450/88; 450/82; 450/58
(58) Field of Search ..... 450/1, 17, 23, 450/25, 55–58, 71, 77, 79, 81, 82, 88, 40–45, 83; 2/67, 267

(56) References Cited

U.S. PATENT DOCUMENTS 1,670,684 A * 5/1928 Leuchtag ..... 450/81
2,079,426 A * 5/1937 Schottenfels ..... 450/81
2,844,151 A * 7/1958 Lemons ..... 450/81
6,231,424 B1 5/2001 Valentin
6,257,951 B1 * 7/2001 DeMarco ..... 450/55
6,257,952 B1 * 7/2001 Valentin ..... 450/81

* cited by examiner

*Primary Examiner*—Gloria M. Hale
(74) *Attorney, Agent, or Firm*—Robin, Blecker & Daley

(57) ABSTRACT

A strapless, backless bra is provided, including two cups and a connector. The connector has a female part affixed to one cup and a male part affixed to the second cup. Each cup has an upper rim, a first and second end, and a lower peripheral area extending below the upper rim from the first end to the second end. The female and male parts of the connector are located at the first end of the first and second cups, respectively, such that when connected, the bra cups may swivel relative to the connector to conform to the shape of the user. The bra cups further include inside and outside surfaces. Dermal adhesive tape may be disposed on the inside surface of each cup, in the peripheral area thereof, for attachment of the cups to the user.

28 Claims, 6 Drawing Sheets

BACKLESS, STRAPLESS BRA WITH SWIVEL SNAP SYSTEM

BACKGROUND OF THE INVENTION

This invention relates to a strapless and backless bra and, more particularly, to a strapless and backless closed-cell foam bra with a swivel snap system that can be adjusted to compensate for anatomical differences or to enhance the appearance of the breasts of the user, and that can be efficiently packaged, stored and shipped.

It is desirable in the selection of undergarments to have a strapless, backless bra that is minimal in size and shape such that it may be worn with different revealing garments while having a structure capable of adjusting to conform to its user's shape, providing uniform support, and enhancing the user's appearance.

Strapless, backless bras are well known in the art. U.S. Pat. No. 6,257,952 teaches a bra of this type having a first and second cup directly joined together. In the bra of the '952 patent, an outer side and inner side of each cup have substantially parallel upper portions, and the upper portions of the inner sides of each cup are sewn together. In addition, opposing tabs are positioned proximate the outer side of each cup for adhering the bra to the outer sides of the user's body. The fixed state of the cups relative to each other, and the adhesion of the bra to the user's body using tabs positioned on the outer side of each cup, precludes any adjustment or flexibility of the bra. This is disadvantageous in the case of users who may wear the same bra size but who are shaped differently. Moreover, unless it is folded (and thereby possibly damaged), the one-piece structure of this bra does not lend itself to efficient packaging, storage or shipment.

Another example of a bra of this type is shown in U.S. Pat. No 6,257,951 for a one-piece, backless, strapless bra. The '951 patent teaches a single piece bra with two cups, underwire, a foam layer, and an aluminum layer that enables the user to mold the shape of the cups to fit the user's personal contours. While the moldability of the cups of the bra addresses minor variations in chest and body shape among women who wear the same cup size, it does not permit movement of the cups relative to each other or to the user's body. In addition, as with the bra of the '952 patent discussed above, the one-piece bra of the '951 patent does not lend itself to efficient packing, shipment or storage.

U.S. Pat. No. 6,231,424 teaches a backless, strapless bra having first and second cups with substantially parallel inner and outer sides, and tabs positioned on the outer sides of the cups. The U-shaped cups are joined together by a bridge connector once the cups are attached to the user's body using two-sided tape on the back surface of each of the tabs. In the '424 patent, the cups may be joined by any suitable connection device such as a releasable snap-fit connector as shown and described in the patent. However, the connection devices taught by this patent do not permit the cups, once connected, to move or pivot relative to the connector or to each other. Thus, regardless of the form of connection used to join the cups, once joined, the cups of the bra are not readily movable. While the combination taught by the '424 patent of connected U-shaped cups and tabs that adhere only to the outer sides of the user's breasts may enhance the lift, support and appearance of the user's breasts, such enhancement is in reality limited to women of relatively uniform breast and upper body shape. Among all women who wear the same cup size, many are shaped differently such that the benefits of this bra cannot be realized without the ability to adjust the position of the cups relative to each other or relative to the user.

A variety of closed cell two-piece foam bras sold as "strapless bras" or "bra cups" are also well known in the art. One example of such a two-piece bra is Magicups, manufactured by Brazabra Corporation, the assignee of this application. Such two-piece bras have adhesive on the inner surface of the separate cups. Although these cups may be freely adjusted to conform to the user's shape, disadvantages of two-piece bras include lack of uniformity in lift and support of the user's breasts, unevenness or distortion in appearance of the breasts, and difficulty positioning the cups evenly and correctly on the body, inter alia.

Therefore, a need exists for a backless, strapless bra for wearing with a variety of revealing clothing that creates symmetrical appearance of the user's breasts and that provides uniform lift and support while also permitting adjustment to conform to or enhance the shape of the user's breasts.

Accordingly, it is a primary object of the present invention to provide a strapless, backless bra which overcomes the aforesaid disadvantages.

It is also an object of the present invention to provide a strapless, backless bra with adjustable cups that can compensate for anatomical differences among women who wear the same bra size but who are shaped differently.

It is a further object of the invention to provide a strapless, backless bra that enhances the appearance and provides uniform support of the user's breasts.

It is another object of the present invention to provide a strapless, backless bra that can be adjusted for use with a greater variety of backless or other revealing clothing.

It is a further object of the present invention to provide a bra that requires much less protective packaging for shipping and much less space for storage.

It is yet a further object of the present invention to provide a strapless, backless bra having a connector system that allows separate closed cell foam bra pads to function as a one-piece bra.

SUMMARY OF THE INVENTION

In accordance with the principles of the present invention, the above and other objectives are realized in a strapless, backless bra comprised of first and second cups and a connector for detachably and pivotally connecting the cups.

In a further aspect of the invention, a strapless, backless bra is provided including first and second cups, each cup having an inner surface and an outer surface; a connector for detachably connecting the two cups, and an adhesive disposed on the inner surface of each cup.

In yet another aspect of the invention, a strapless, backless bra is provided with first and second cups, each cup having a peripheral portion and first and second ends, and a mechanism for connecting the cups, each cup having a part of the connecting mechanism affixed thereto, at the first end of the cup, such that the cups, when connected, can pivot freely relative to the mechanism, and such that the bra, when adhered to the user, maintains its adjusted shape.

BRIEF DESCRIPTION OF THE DRAWINGS

The above and other features and aspects of the present invention will become more apparent upon reading the following detailed description in conjunction with the accompanying drawings, in which.

DETAILED DESCRIPTION OF THE INVENTION

Figure 1:
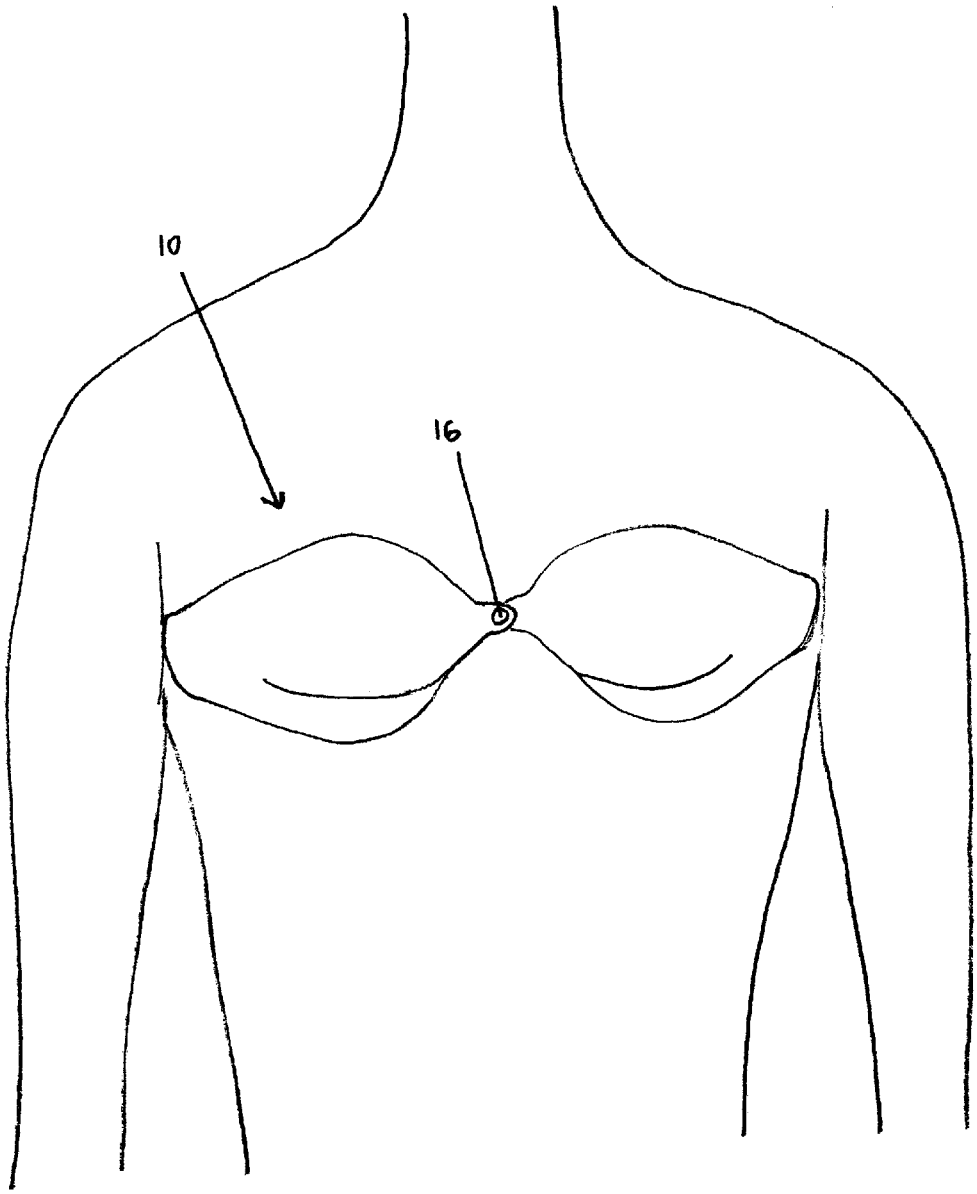
FIG. 1 is a front view of a strapless, backless bra in accordance with the present invention showing the manner in which it is worn.

Referring to the accompanying drawings, which are incorporated in and constitute a part of the specification, FIGS. 1–6 illustrate a preferred embodiment of the present invention. FIG. 1 shows the strapless, backless bra 10 with connector 16 in accordance with the principles of the present invention. The bra 10 comprises at least one layer of non-toxic and non-irritant flexible foam material, such as Volara® or other closed cell polyurethane foam.

Figure 2:
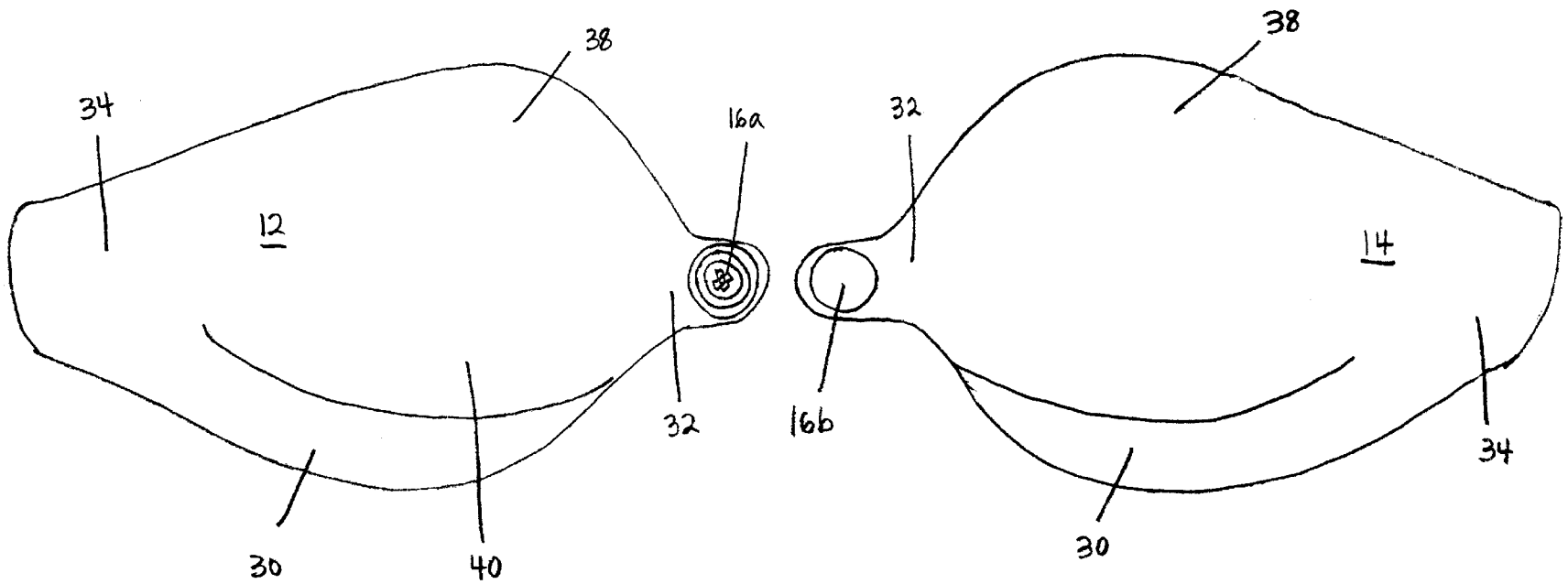
FIG. 2 is a front view of the strapless, backless bra in accordance with the present invention showing the first and second cups detached.
Figure 3:
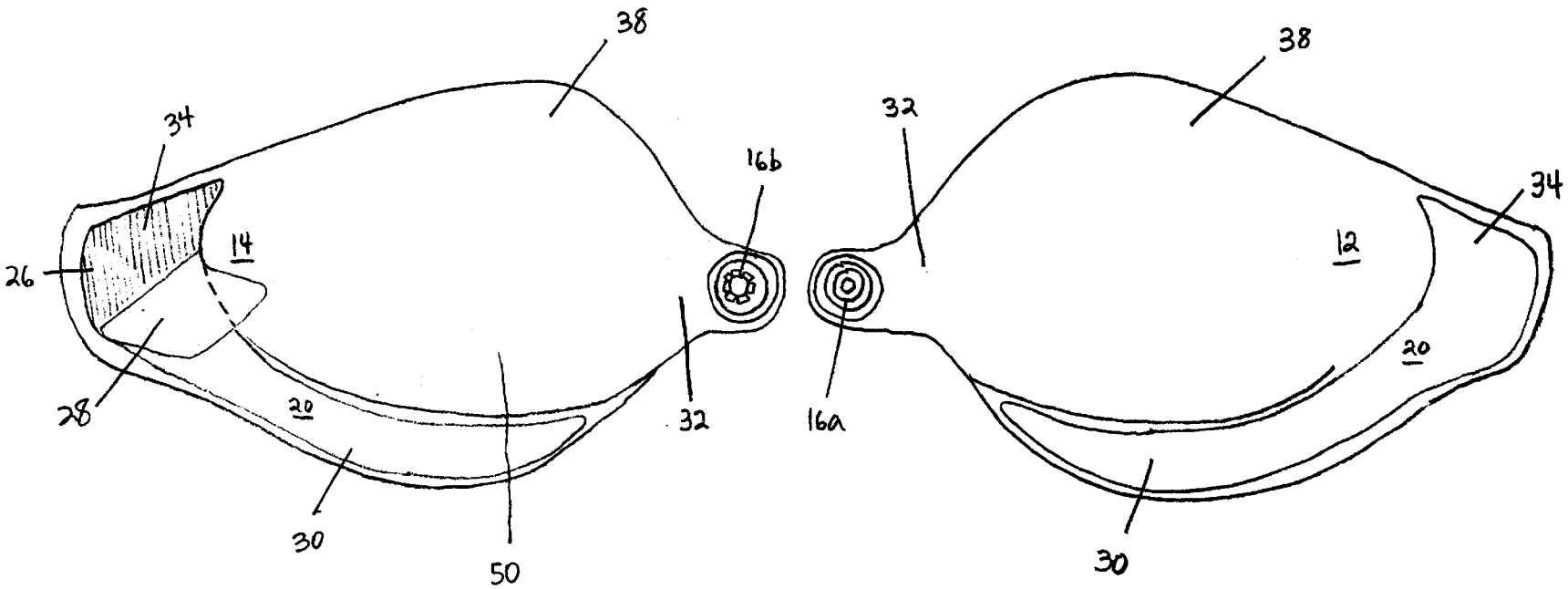
FIG. 3 is a back view of the strapless, backless bra of the present invention shown in FIG. 2.

Bra 10 is illustrated in greater detail in FIGS. 2 and 3. As shown in FIGS. 2 and 3, bra 10 includes right cup 12 and left cup 14. Each of right and left cups 12, 14 has an outer surface 40 (shown in FIG. 2) and an inner surface 50 (shown in FIG. 3). The outer surface 40 of each cup has a polyester circular knit fabric or similar knit fabric disposed thereon. The knitted fabric layer is applied to the outer surface 40 of each cup 12, 14 by a flame lamination process, which is well-known in the art, whereby the foam is heated to a temperature such that the knit fabric will adhere to it.

Right and left cups 12, 14 are symmetrical, and each cup includes a peripheral portion 30 and upper rim 38. As shown in FIGS. 2 and 3, each cup 12, 14 terminates at a first end 32 and second end 34. In addition, the peripheral portion 30 of each cup 12, 14 generally extends from the vicinity of the first end 32 of the cup, continuing below the upper rim 38 of each cup, and terminating at the second end 34 of the cup.

Figure 4:
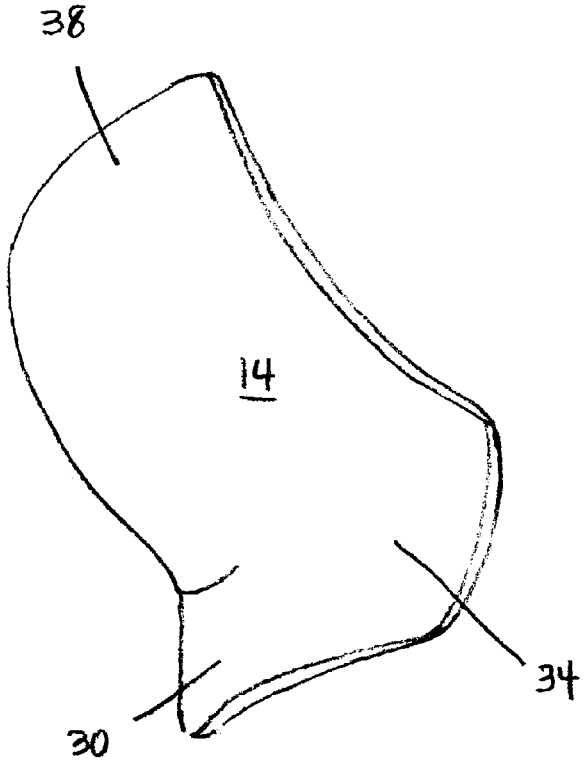
FIG. 4 is a right side view of the strapless, backless bra of the present invention shown in FIG. 2, the left side view being a mirror image thereof.

As shown in FIG. 4, the peripheral portion 30 of each cup 12, 14 is relatively flat for comfortable placement proximate to the underside and outer sides of the user's breast. In contrast, the upper rim 38 of each cup 12, 14 is convex in shape to conform to the general shape of the user's breast. It is understood that peripheral portion 30 may be larger or smaller in width, depending on the bra cup size, than is generally shown in the drawings. It is further understood that peripheral portion 30 may have a more convex shape such that it may not be as readily distinguishable from the upper rim 38 as shown in the figures. Similarly, upper rim 38 of each cup 12, 14 may be more or less convex, more rounded or pointed in shape, or may have a more oval or more circular or semi-circular perimeter than shown in the drawings to accommodate various breast shapes.

As described above and shown in the drawings, right and left cups 12, 14 are symmetrical. They may be substantially oval-shaped, as shown in FIGS. 1–6, or they may be semi-circular for use with low-cut garments. It is understood that the shape and overall curvature of right and left cups 12, 14 is not limited to those described and depicted herein. Rather, it is understood that cups 12, 14 may be of any shape, size and curvature practicable to allow use with various garments while accommodating the shape and size of the user's breasts, providing uniform support and enhancing appearance, while also permitting adjustment of the cups.

In the preferred embodiment of the invention, right and left cups 12, 14 of the bra 10 are attachable to each other by a connector 16, which may be any mechanism capable of connecting cups 12 and 14 and permitting movement of the cups relative to each other, such as a snap, as shown. However, it should be understood that alternative equivalent mechanisms exist that are capable of connecting cups 12 and 14 while permitting free movement of the cups. In a preferred embodiment, the connector 16 comprises a snap having a female part 16*a* and a male part 16*b*. The snap is preferably made of metal and plastic, but other materials may be used which permit pivotal movement of the cups 12, 14 relative to the snap 16, when the female part 16*a* and male part 16*b* are engaged, as described further below.

FIG. 1 shows the right and left cups 12, 14 connected by a snap. FIGS. 2 and 3 illustrate the snap mechanism of FIG. 1 in greater detail. A female part 16*a* is affixed to a first end 32 of the right cup 12 and a male part 16*b* is affixed to a corresponding first end 32 of the left cup 14. Right cup 12 and left cup 14 may be connected by engaging the female snap part 16*a* with male snap part 16*b*, either before or after adhering cups 12, 14 to the user's body. It is understood that female part 16*a* and male part 16*b* of the connector 16 are interchangeable with respect to the right and left cups 12, 14. In any event, by engaging female part 16*a* and male part 16*b*, a portion of the outside surface 40 of one of cups 12, 14 is in contact with a portion of the inside surface 50 of the other of cups 12, 14.

Figure 5A:
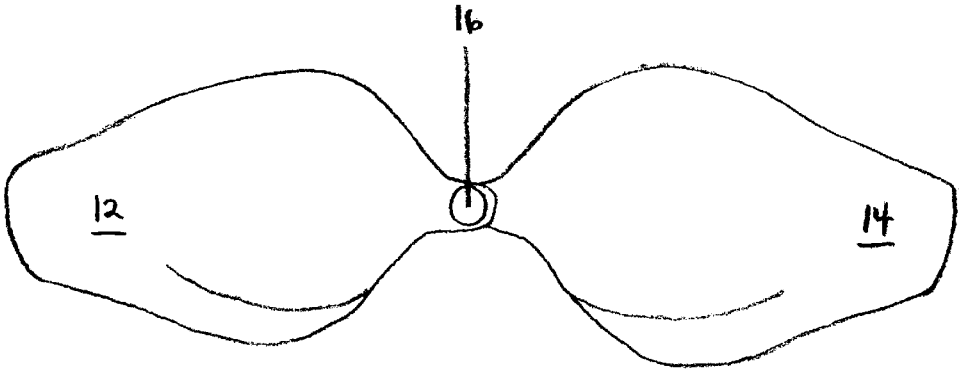
FIG. 5A is a front view of the strapless, backless bra in accordance with the present invention showing the first and second cups connected and in a normal position.
Figure 5B:
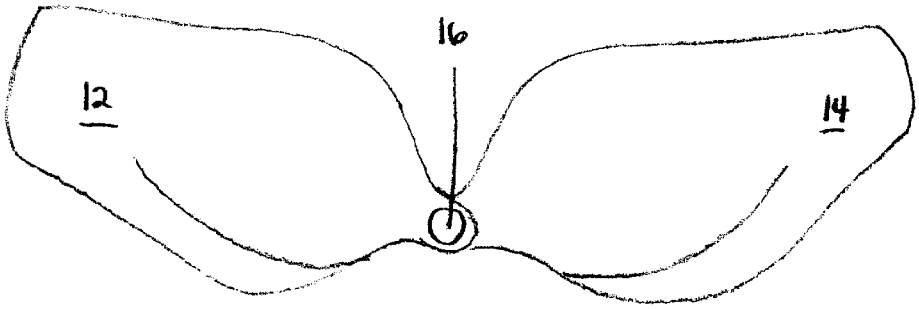
FIG. 5B is a front view of the strapless, backless bra in accordance with the present invention showing the first and second cups connected and pivoted upwardly.
Figure 5C:
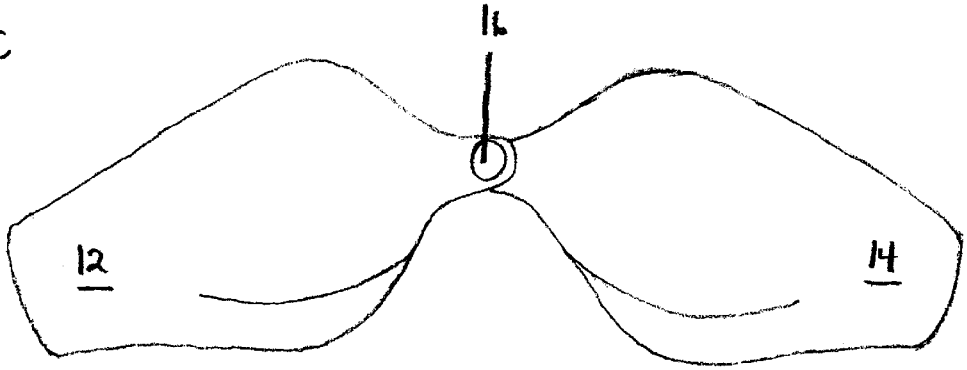
FIG. 5C is a front view of the strapless, backless bra in accordance with the present invention showing the first and second cups connected and pivoted downwardly.

Once connected, right cup 12 and left cup 14 of the bra 10 are capable of pivoting relative to the connector 16. As shown in FIGS. 5A–5C, adjustment of the bra 10 by pivoting the cups 12, 14 enables each user of the same bra 10 to conform the bra 10 to the unique shape of her breasts and permits use of the bra 10 with many different garments. The cups 12, 14 may be swiveled upwardly relative to the connector 16, as shown in FIG. 5B, or downwardly, as shown in FIG. 5C. Positioning the cups in an upward fashion as illustrated in FIG. 5B also enhances the appearance of the user's breasts by creating more cleavage.

As shown in FIG. 3, double-sided adhesive tape 20 may be disposed on the inside surface 50 of each cup, within the peripheral portion 30 thereof. The adhesive tape 20 includes a bra-side adhesive 24 (not shown) by which the tape 20 adheres to the inside surface 50 of the cups 12, 14 and a breast-side medical grade non-sensitizing adhesive 26 for adhering the bra cups to the user that is non-irritating to the skin. Such double-sided tape, in which the adhesives on both sides are preferably hypoallergenic and pressure sensitive, is well known in the art. It is understood that many equivalent adhesive materials exist and may be used to adhere cups 12 and 14 of the bra 10 to the user.

A backing 28 is disposed on the breast-side adhesive 26 to prevent exposure of the adhesive before use of the bra 10. Once a user has positioned cups 12 and 14 of the bra 10 and is ready to use the bra, the backing 28 is peeled off to expose the breast-side adhesive 26 and pressure is applied to the outside surface 40 of each cup 12, 14 along the peripheral portion 30 thereof to effect bonding of the adhesive to the skin of the user. The adhesion of the bra to the user along the peripheral portion of each cup 12, 14 and along the corresponding underside and outer sides of each of the user's breasts maintains the adjusted position of cups 12, 14 relative to the connector 16 and to each other. To remove the bra, cups 12, 14 can be detached and pulled away from the user's breasts.

Figure 6:
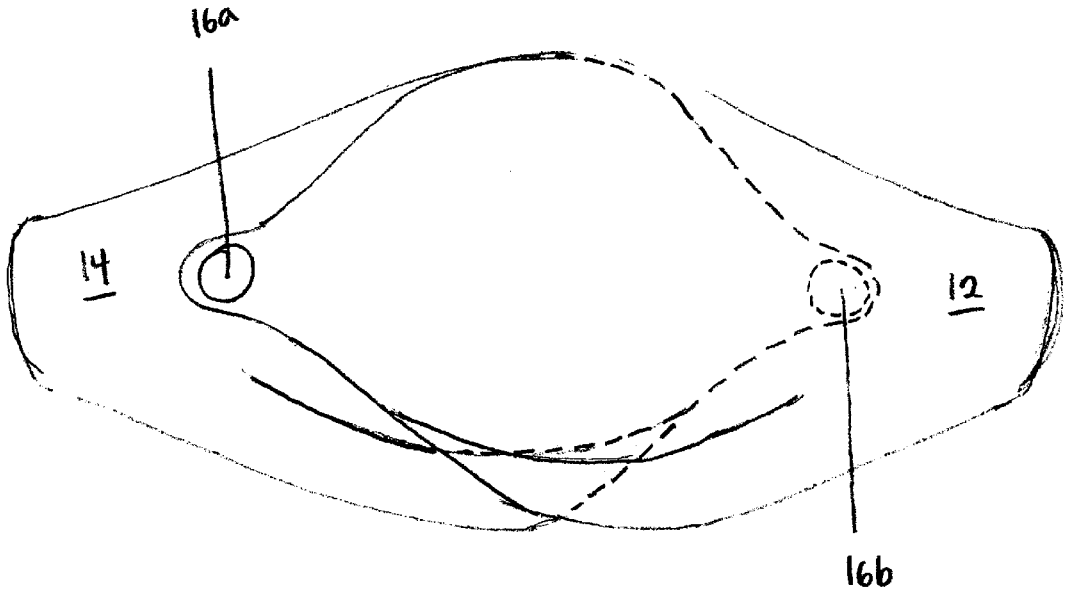
FIG. 6 is a front view of the strapless, backless bra in accordance with the present invention showing the right and left cups in a detached and nested position.

As shown in FIG. 6, cups 12 and 14 may be detached and nested. Such an arrangement reduces the dimensions of the bra by approximately 50% and requires significantly less material for packing and shipping than a conventional one-piece bra. In addition, the bra 10 in a nested position requires much less storage space than a one-piece bra.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention, as defined by the accompanying claims.

What is claimed is:

1. A strapless and backless bra, comprising:

a first cup and a second cup for attachment to a user's body; and a connector for detachably and pivotally connecting said first cup and said second cup;

wherein said connector enables said first and second cups to be pivoted in a plane parallel to a surface of said users body.

2. A strapless and backless bra in accordance with claim 1, wherein said connector comprises a snap having a female part affixed to said first cup and a male part affixed to said second cup.

3. A strapless and backless bra in accordance with claim 2, wherein each of said first cup and said second cup further comprises a peripheral region and a first and a second end.

4. A strapless and backless bra in accordance with claim 3, wherein said female part and said male part of said snap are disposed, respectively, at the first end of said first cup and the first end of said second cup.

5. A strapless and backless bra in accordance with claim 2, wherein each of said first and second cups further comprises an upper rim, a first end, a second end, and a peripheral area extending from the vicinity of the first end and below the upper rim to the second end.

6. A strapless and backless bra in accordance with claim 5, wherein said female and male snap parts are disposed, respectively, in the first and second cups at the first end of each of said cups.

7. A strapless and backless bra, comprising;

a first cup and a second cup, each cup having an inside surface and an outside surface;

a connector for detachably connecting said first cup and said second cup; and adhesive material disposed on the inside surface of a peripheral portion of each of said first cup and said second cup for attachment of each of said first cup and said second cup to a user's body;

wherein said connector enables said first and second cups to be pivoted in a plane parallel to a surface of said user's body.

8. A strapless and backless bra in accordance with claim 7, wherein said connector comprises a snap having a female part affixed to said first cup and a male part affixed to said second cup.

9. A strapless and backless bra in accordance with claim 8, wherein each of said first cup and said second cup further comprises a first end and a second end.

10. A strapless and backless bra in accordance with claim 9, wherein said female part and said male part of said snap are disposed, respectively, at the first end of said first cup and the first end of said second cup.

11. A strapless and backless bra in accordance with claim 9, wherein said first cup and second cup of said bra each further comprises an upper rim, said peripheral portion of each cup extending from the vicinity of said first end, below the upper rim, to the second end.

12. A strapless and backless bra in accordance with claim 7, wherein said first cup and said second cup are capable of pivoting freely relative to said connector.

13. A strapless and backless bra in accordance with claim 7, wherein a portion of the outside surface of said first cup is in contact with a portion of the inside surface of said second cup when said first cup and said second cup are connected by said connector.

14. A strapless and backless bra in accordance with claim 7, wherein said adhesive material is an acrylic-based double-sided adhesive.

15. A strapless and backless bra in accordance with claim 7, further comprising at least one removable backing disposed on the adhesive material.

16. A strapless and backless bra in accordance with claim 15, wherein said backing is made of paper.

17. A strapless and backless bra in accordance with claim 1, wherein said first cup and said second cup are symmetrical.

18. A strapless and backless bra in accordance with claim 17, wherein said first cup and said second cup are substantially oval in shape.

19. A strapless and backless bra in accordance with claim 1, wherein said first and second cups may be nested for packaging, storage or shipment.

20. A strapless and backless laminated closed-cell foam bra, comprising;

a first cup and a second cup, each cup having an inside surface, an outside surface, a peripheral region, and a first and second end;

a snap for detachably and pivotally connecting said first cup and second cup, said snap comprising a female part affixed to said first cup and a male part affixed to said second cup; and adhesive material disposed on the inside surface of each of said first cup and second cup for attachment of each of said first cup and said second cup to a user's body;

wherein said female and male parts are affixed to said first and second cups, respectively, at the first ends of said first and second cups, and wherein said snap enables said first and second cups to be pivoted in a plane parallel to a surface of said user's body.

21. A strapless and backless bra in accordance with claim 20, wherein said first cup and second cup of said bra each further comprises an upper rim, said peripheral region of each cup extending from the vicinity of said first end below the upper rim to said second end.

22. A strapless and backless bra in accordance with claim 21, wherein said adhesive material is disposed on the inside surface of each of said first and second cup at the peripheral region thereof.

23. A strapless and backless bra in accordance with claim 20, wherein said first and second cups comprise closed cell polyurethane foam.

24. A strapless and backless bra in accordance with claim 23, wherein said inside surface of said first and second cups comprises a layer of closed cell polyurethane foam material, and said outside surface of said first and second cups comprises a layer of polyester circular knit fabric.

25. A strapless and backless bra, comprising;

a first cup and a second cup, each cup having an inside surface and an outside surface;

a connector for detachably connecting said first cup and second cup;

adhesive material disposed on a portion of the inside surface of each of said first cup and second cup for attachment of said first cup and said second cup to a user's body; and a backing disposed on said adhesive material on each of said first cup and second cup, wherein said first and second cups, when connected by said connector, may freely pivot relative to said connector and in a plane parallel to a surface of the user's body.

26. A strapless and backless bra in accordance with claim 25, wherein said first cup and second cup each further comprises a first end, a second end, an upper rim, and a peripheral portion extending from said first end, below said upper rim, to said second end.

27. A strapless and backless bra in accordance with claim 26, wherein said adhesive material is disposed on the inside surface of the peripheral portion of said first cup and second cup.

28. A strapless and backless bra in accordance with claim 25, wherein the connector comprises a snap mechanism.

* * * * *